US005890228A

United States Patent [19]

Wagner

[11] Patent Number: 5,890,228

[45] Date of Patent: Apr. 6, 1999

[54] BATTING GLOVE

[76] Inventor: Steven J. Wagner, 172 Mettler St., Toledo, Ohio 43608

[21] Appl. No.: 853,456

[22] Filed: May 9, 1997

[51] Int. Cl.[6] ..... A41D 19/00

[52] U.S. Cl. ..... 2/160; 2/161.1

[58] Field of Search ..... 2/19, 160, 161.1, 2/161.2, 161.5; D2/617, 623

[56] References Cited

U.S. PATENT DOCUMENTS

| | | | |
|---|---|---|---|
| 3,606,319 | 9/1971 | Borden | 2/161.1 |
| 5,184,815 | 2/1993 | Maddox | 273/26 C |
| 5,218,719 | 6/1993 | Johnson | 2/161.1 |
| 5,353,440 | 10/1994 | Meldeau | 273/26 C |
| 5,435,013 | 7/1995 | Davis | 273/26 C |
| 5,471,681 | 12/1995 | Ferrini | 2/161.1 |
| 5,471,682 | 12/1995 | Robbins et al. | 273/26 C |
| 5,634,214 | 6/1997 | St.Ville | 2/161.1 |

*Primary Examiner*—C. D. Crowder
*Assistant Examiner*—Larry D. Warrell, Jr.
*Attorney, Agent, or Firm*—Patent & Trademark Services; Joseph H. McGlynn

[57] ABSTRACT

A batting glove which has a plurality of straps to secure the glove to a player's hands to insure a proper fit. It also has a relatively rigid channel shaped support fastened to the palm area of the glove which requires that the user grip the bat in the proper manner.

6 Claims, 1 Drawing Sheet

FIG. 1
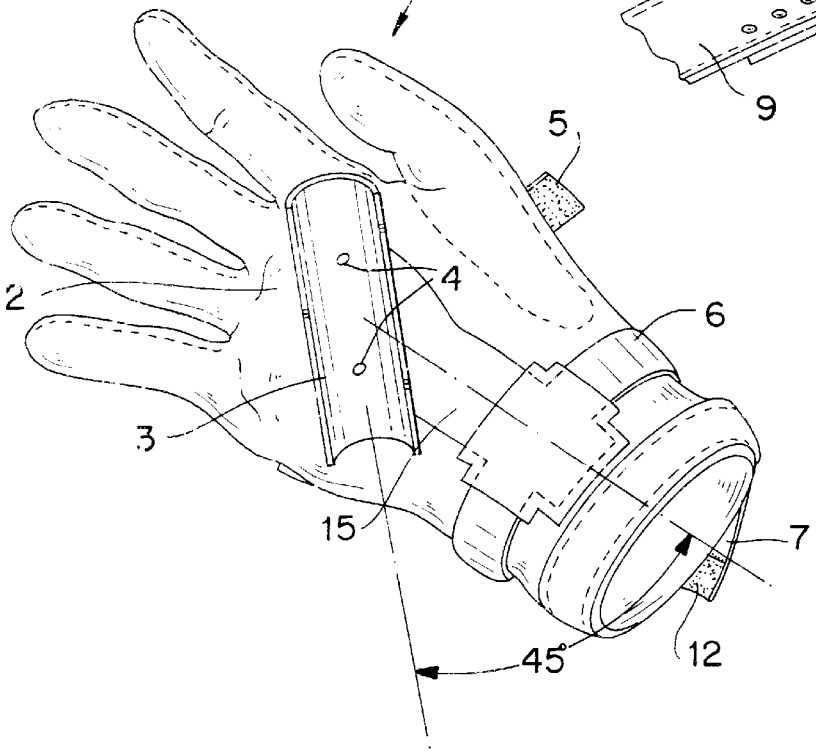
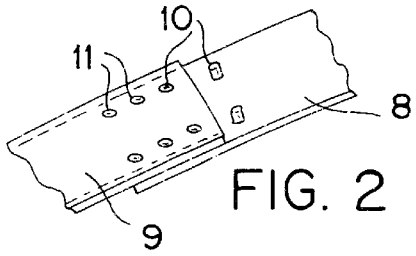
FIG. 2
FIG. 3
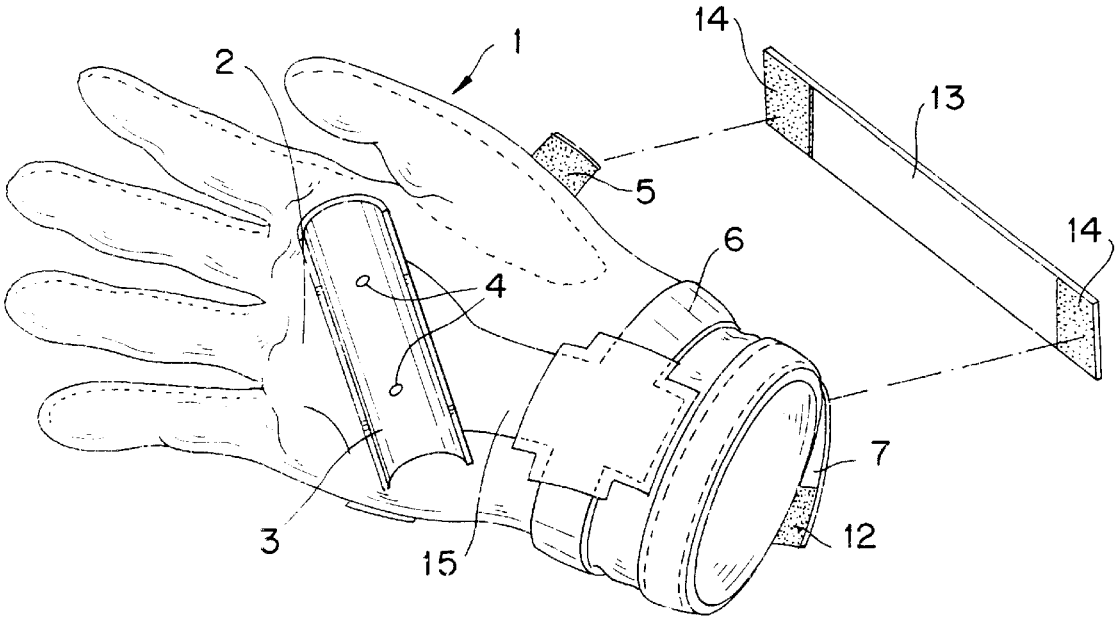

BATTING GLOVE

BACKGROUND OF THE INVENTION

This invention relates, in general, to a baseball training aid, and, in particular, to a batting glove which is used as a training aid to assist players, especially young players, in proper bat and hand placement which will result in a proper swing.

DESCRIPTION OF THE PRIOR ART

In the prior art various types of batting aids have been proposed. For example, U.S. Pat. No. 5,184,815 discloses a batting glove with elongated strips of material placed on the finger portions of the glove. The strips include Velcro hook and loop fasteners which hold buttons at selected positions on the strips. The buttons can be adjusted for individual players so the player can line up the button and see if his/her hands are properly positioned on the bat.

U.S. Pat. No. 5,353,440 discloses a glove used for water skiing which has a bearing surface on the palm of the glove to support the handle on a water skiing tow rope.

U.S. Pat. No. 5,435,013 discloses a glove for use with sport activities such as baseball, tennis or golf. The glove has extra long fingers which can be wrapped around the object to be grasped by the player and the ends of the fingers can be fastened to the glove by Velcro type hook and loop fasteners.

U.S. Pat. No. 5,471,682 discloses a batting glove which has a raised ridge in the palm of the glove that is perpendicular to the the axis of the arm of the user. The raised ridge spaces the bat handle away from the vee of the thumb to provide proper bat placement in the player's hands.

While the prior art devices offer some instructional aid in developing proper hand and bat positioning, all suffer serious drawbacks. For example, U.S. Pat. No. 5,184,815 provides only a visual aid for the batter which he/she can ignore if they so choose. Unless the user chooses to utilize the glove in the proper manner they will receive no benefit from it. This is especially important in young players who will usually take the easy way out when they first start to learn the proper way to play a sport. In the beginning, proper hand bat positioning will "feel" uncomfortable until a player becomes used to the position and sees the results of proper positioning. Until this occurs it is vital that batting glove allows the player no option but to grip the bat in the proper manner.

U.S. Pat. No. 5,353,440 is designed to assist a water skier in holding onto the handle of a tow rope and can not teach proper hand bat positioning since it is perpendicular to the user's arm.

U.S. Pat. No. 5,435,013 allows the user to "cheat" on the bat hand positioning depending on how tightly or how loosely the extended fingers are wrapped around the bat.

U.S. Pat. No. 5,471,682 is designed for more mature players whose hands and fingers are long enough to grip the bat with the fingers alone and without any assistance from the player's palms. Younger players, whose fingers are too short to grip the bat in this manner, do not have the physical qualities to utilize this aid.

What is needed is a batting aid which allows the player no opportunity to "cheat" when using the batting aid. He/she must grip the bat in a proper manner, which in time will become second nature to the player and he/she will always grip the bat in the proper manner even if not using the training aid.

SUMMARY OF THE INVENTION

The present invention consists of a batting glove which has a plurality of straps to secure the glove to a player's hands to insure a proper fit. It also has a relatively rigid channel-shaped support fastened to the palm area of the glove which requires that the user grip the bat in the proper manner, which then requires that the player swing the bat properly.

It is an object of the present invention to provide an improved batting glove which is suitable to be used by young players just learning the fundamentals of a sport.

It is an object of the present invention to provide an improved batting glove which will require the user to use proper hand bat positioning which causes the player to swing the bat properly.

It is an object of the present invention to provide an improved batting glove which is capable of being used by players regardless of the age or physical size of the player.

These and other objects and advantages of the present invention will be fully apparent from the following description, when taken in connection with the annexed drawings.

BRIEF DESCRIPTION OF THE DRAWINGS

FIG. 1 is perspective view of the present invention.

FIG. 2 is a view of an alternative securing strap that can be used with the present invention.

FIG. 3 is a view of a second alternative securing strap that can be used with the present invention.

DESCRIPTION OF THE PREFERRED EMBODIMENT

Referring now to the drawings in greater detail, FIG. 1 shows a batting glove 1 which is designed to be worn by a player while batting. It should be noted that while the invention is described as being worn by a baseball or softball player, the present invention is not limited solely to these sports. The present invention can be used in any sport in which a player grips a piece of equipment that has a cylindrical type handle. Sports such as, but not limited to, golf, tennis, and racquetball can use the present invention. In addition, although only a right handed glove is shown in the drawings, this is solely for illustration purposes and it should be under stood that a left handed glove having the same accessories would also be included in the present invention.

The glove 1 would be made from Nylon, or some similar material, and would have a plurality of straps 5, 6, and 7 which are attached at one end to the glove such as, but not limited to, sewing. The other ends of the straps will have attachment means, shown at 12 on strap 7, such as, but not limited to, Velcro hook and loop type fasteners. On the back of the gloves complimentary Velcro hook and loop type fasteners (not shown) would be placed in position to cooperate with the ends of straps 5, 6, and 7 to secure the straps in place.

In the palm area 2 of each glove (both right and left hands) is a support frame 3. The support frame is preferably made from high grade semi rigid rubber, although other materials such as, but not limited to, plastic can be used. The support frame 3 is attached to the palm of each glove by sewing at at least two positions 4, as shown in FIGS. 1 and 3, in order to secure the support frame 3 in proper position on the gloves. The support frame is semi-cylindrical or U-shaped so a standard bat handle will fit snugly within the concave portion of the support frame 3. Also, the frame should be tapered to fit the standard tapered bat handle.

The longitudinal axis of the support frame 3 should make a 45° angle with the user's wrist and arm, as shown in FIG. 1. This will place the bat handle in the proper position, and since the support frame 3 is relatively rigid, the player will not be able to "cheat" by holding the bat in an improper position. If a player attempts to cheat, he/she will not be able to hold the bat properly or at all. With the bat held in the proper position, a player will have to swing the bat in a proper manner since the support frame 3, because of its rigidity, will not allow an improper swing.

As an alternative, the support frame 3 could be made separate from the glove portion so it could be used with existing, off-the-shelf gloves. In order to do this the support frame 3 would be attached to the wrist strap 6 which has an extension piece 15 unitary therewith. The wrist strap and the support frame would be separate from the glove. In all other aspects, the glove would be the same as shown in FIG. 1. By wrapping the wrist strap 6 around the user's wrist after the glove is on, a player will be able to use the support frame 3 with a standard batting glove.

In FIG. 2 an alternative to the Velcro hook and loop fasteners that secure the straps 5, 6, and 7 are shown. In this embodiment the free end of the straps could have a series of holes 11 which would fit onto pins or protuberances 10. By moving the end of the straps over the proper pins 10, the tightness of the straps around the user's wrists and hands can be adjusted. It should be noted that the straps 8, 9 could be two straps as shown in FIG. 2 or it could be a single strap 9 and the pins 10 could be attached directly to the back or side of the glove.

FIG. 3 shows another adjustment strap 13, which has Velcro hook and loop fasteners 14, or some similar fastening means, attached at opposite ends of the straps. There is cooperating fastening means on the rear of the gloves which will secure the straps 13 in place. The strap 13 would be placed over the straps 5, 6, and 7 to help secure them in place.

The glove portion is manufactured using conventional cut and sew fabric techniques. This portion of the batting glove is similar in construction to many conventional sports gloves in use today, and should be available as an off-the-shelf item.

The tapered support frame 3 is a one piece component manufactured of semi-rigid molded rubber or plastic. It would be best manufactured using an injection molded process. This plastic molding process utilizes heat softened plastic material which is forced under very high pressure into a metal cavity mold which is relatively cool. The inside cavity mold is comprised of two or more halves and is the same desired shape as the product to be formed. High pressure hydraulics are used to keep the mold components together during the actual injection phase of the molding process. The injected plastic is allowed to cool and harden. The hydraulics holding the multiple component cavity together are released, the halves of the mold separated and the solid formed plastic item is removed. This process can easily be automated and is capable of producing extremely detailed parts at a very cost effective price.

In use, a batter would put on a pair of the gloves of the present invention prior to batting. If the gloves have a separate support frame 3, this would be put on after the gloves are on. Use of the present invention would insure proper placement of a batter's hands on the bat through alignment of the fingers as well as provide proper hand position while the player is swinging, as well as requiring that the player "roll" his/her wrists properly at the end of the swing. Therefore, the player will have to hold the bat in the proper position, and this positioning of the hands and the rigidity of the support 3 will teach a player the proper way to hold a bat and the proper way to swing the bat. In addition, the gloves will provide added wrist and hand protection from the impact of the bat hitting a ball.

Extended use of the present invention with young players would teach proper hand and wrist positioning from the proper initial grip to the proper follow through of the swing. Over a period of time, the player would learn through "muscle memory" the correct way to hold and swing a bat.

Although the batting glove and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A teaching and training aid for athletes comprising:

at least one glove, said glove having a thumb portion and a plurality of finger portions, said glove also having a palm portion and a portion for covering a user's wrist, said glove having at least one strap secured thereto, said strap having a free end, said free end having a fastening means which cooperates with a second fastening means on said glove for holding said strap in place, said palm portion having a support means secured thereto, said support portion being semi-circular in shape and having a longitudinal axis, said longitudinal axis makes approximately a 45° angle with a longitudinal axis of a user's wrist, said support portion having a front portion which is concave and a back portion which is convex, said back portion being immediately adjacent said palm portion and said front portion being remote from said palm portion.

2. The teaching and training aid for athletes as claimed in claim 1, wherein said support portion is integral with said palm portion.

3. The teaching and training aid for athletes as claimed in claim 1, wherein said support portion is integral with a strap means which encircles said portion for covering a user's wrist.

4. The teaching and training aid for athletes as claimed in claim 1, wherein said fastening means are hook and loop fasteners.

5. The teaching and training aid for athletes as claimed in claim 1, wherein said fastening means are a plurality of apertures which cooperate with a plurality of pins to secure said at least one strap in place.

6. The teaching and training aid for athletes as claimed in claim 1, wherein said glove has at least one second strap which has fastening means at opposite ends, said at least one second strap being secured over said at least one strap.

* * * * *